US005708468A

United States Patent [19]

Iwao

[11] Patent Number: 5,708,468

[45] Date of Patent: Jan. 13, 1998

[54] IMAGE FORMING DEVICE UTILIZING HOT MELT INK

[75] Inventor: Naoto Iwao, Nagoya, Japan

[73] Assignee: Brother Kogyo Kabushiki Kaisha, Nagoya, Japan

[21] Appl. No.: 774,369

[22] Filed: Dec. 27, 1996

[30] Foreign Application Priority Data

Feb. 15, 1996 [JP] Japan ..... 8-027876

[51] Int. Cl.[6] ..... B41J 2/33

[52] U.S. Cl. ..... 347/213; 347/173

[58] Field of Search ..... 347/171, 172, 347/173, 213; 400/120.01, 120.02

[56] References Cited

U.S. PATENT DOCUMENTS 4,882,593 11/1989 Touma et al. ..... 347/213

FOREIGN PATENT DOCUMENTS 60-058879 4/1985 Japan .

5-238028 9/1993 Japan .

*Primary Examiner*—Huan H. Tran

*Attorney, Agent, or Firm*—Oliff & Berridge

[57] ABSTRACT

In an image forming device, a hot melt ink is preliminarily heated by a heater, the melted ink is retained in an ink retaining roller made of a porous material and having apertures formed in the radial direction, and then melted under heating by a thermal head and transferred on a recording medium. The ink supply device of the image forming device can use inks efficiently with no waste and thereby reduce the running cost.

24 Claims, 7 Drawing Sheets

IMAGE FORMING DEVICE UTILIZING HOT MELT INK

BACKGROUND OF THE INVENTION

1. Field of the Invention

The present invention relates to an image forming device. More specifically, it relates to a melting thermal transfer type image forming device utilizing a hot melt ink.

2. Description of Related Art

A thermal transfer type image forming device 400 in the prior art comprises, as shown in FIG. 1, a thermal head 410, an ink medium 420 and a recording device 430. The thermal head 410 comprises a head 411 containing an ohmic heat generating element that generates heat by the supply of electric current and a driving power source 412 for controlling the heat generation of the head 411 in accordance with image signals supplied from a control circuit, not illustrated. Further, the ink medium device 420 comprises a base film 421 and a melting ink layer 422. The recording device 430 comprises paper 431 and a platen 432 disposed on the side opposite to the head 411, with the paper 431 being interposed therebetween. The image forming device 400 as described above is adapted such that the head 411 generates heat by the application of driving signals from the driving power source 412 to the head 411 in accordance with image signals sent from the control circuit not illustrated. An ink is melted from the ink layer 422 of the ink medium 420 by the heat and transferred to the paper 431 thereby forming images corresponding to the image signals on the paper 431.

In the thus constituted thermal transfer type image forming device of the prior art, since images are formed by melting and transferring only the ink of the ink layer from the base film onto the recording medium, the ink in the portion of the ink layer not used for the image formation is kept as it is on the base film. Meanwhile, a scant amount of ink remains in the portion of the ink layer used for the image formation. Accordingly, since the ink medium can not be used again for image formation in this state, the ink medium must be discarded after only one use. This consumes the ink wastefully and increases the running cost.

A method of regenerating an ink ribbon has been proposed, for example, as disclosed in Japanese Unexamined Patent Publication No. 5-238028. The thermal transfer recording device of this method adopts such a constitution that an ink melted by a heater is stored in an ink reservoir. The liquid ink is supplied to a tubular ink supplement member, and the hot melt ink is supplemented by the ink supplement member to an ink film.

However, since the hot melt ink is melted by heating and reserved in the ink reservoir in the form of liquid in this method, it involves a problem of requiring an enormous amount of heat energy. Further, if the surface of the regenerated ink ribbon is not smooth, uneven images are formed. Thus, it is necessary to make the surface of the regenerated ink ribbon as smooth as possible. However, smoothing of the ribbon surface is difficult.

SUMMARY OF THE INVENTION

The present invention has been accomplished for overcoming the foregoing and other problems. An object of the present invention is to provide an image forming device having an ink supply capable of using an ink thoroughly with no loss and with a small amount of heat energy.

In accordance with an image forming device of the present invention, a hot melt ink is used. A preliminary heating mechanism for preliminarily heating the ink, an ink retaining body for retaining the ink melted by preliminary heating, and a thermal recording mechanism for heating the hot melt ink retained in the ink retaining body are provided to thereby melt and transfer the ink onto a recording medium.

In one embodiment of the present invention, the ink retaining body may be a roller comprising a porous material.

In another embodiment of the present invention, apertures may be formed in the radial direction of the roller for the ink retaining body.

As apparent from the foregoing explanation, in accordance with the image forming device of the present invention, the ink is supplied continuously to an image forming position along with image formation. Thus, the ink can be used with no loss, and running cost for the image formation can be kept as low as possible.

Further, in accordance with the image forming device of the present invention, since the ink is heated preliminarily and the ink is once retained in the roller-shaped retaining body, thermal transfer recording can be conducted with a small amount of heat energy. As a result, recording speed can be increased easily.

Further, in accordance with the image forming device of the present invention, since the apertures of the roller forming the ink retaining body extend in the radial direction of the roller, the ink retained in the ink retaining body can be used effectively to the transfer recording operation. As a result, high speed recording can be attained with a further reduced heat energy.

BRIEF DESCRIPTION OF THE DRAWINGS

Preferred embodiments of the present invention will be described in details with reference to the following figures wherein.

DESCRIPTION OF PREFERRED EMBODIMENTS

The present invention will be explained by way of preferred embodiments with reference to the drawings.

Figure 1:
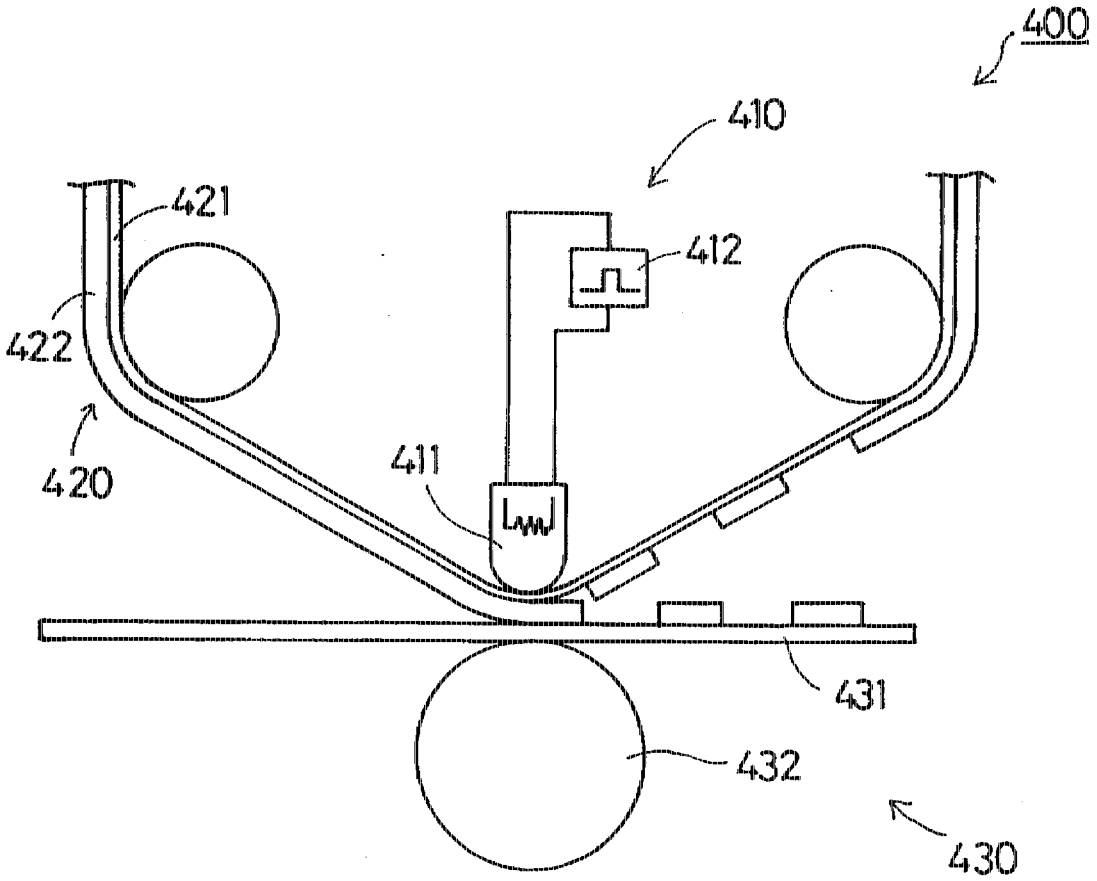
Fig.1 RELATED ART
FIG. 1 is a schematic side view illustrating a melting thermal transfer type image forming device of the prior art.
Figure 2:
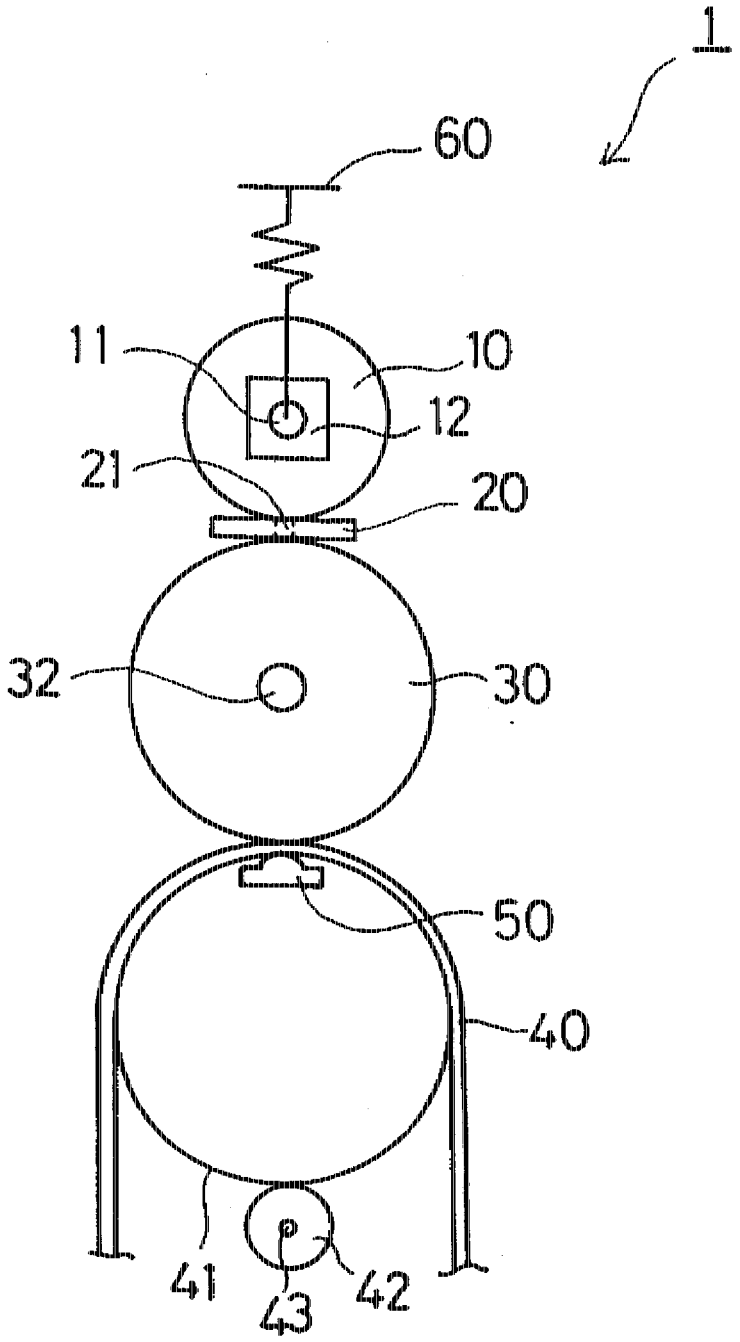
FIG. 2 is a schematic side view for an image forming device in one embodiment of the present invention.

At first, description is to be made for the constitution of an image forming device of a preferred embodiment with reference to FIG. 2.

The image forming device 1 comprises a hot melt ink member 10, a heater 20 for preliminary heating the hot melt ink member 10, and a porous ink retaining roller 30 for absorbing and retaining an ink melted by preliminary heating of the heater 20. A thermal head 50 heats the ink retaining roller 30 and heats the ink absorbed and retained in the ink retaining roller 30. By this, the ink is melted and transferred to a recording medium 40, which is supported by a recording medium feed roller 41 for moving the recording medium 40 in accordance with the image forming operation.

The hot melt ink member 10 is formed cylindrically around a shaft 11. Further, the hot melt ink member 10 is pressed to the heater 20 at a predetermined pressure by the resilient urging of a spring 60 to the shaft 11. Further, the heater 20 is pressed to the ink retaining roller 30 by the pressing force from the hot melt ink member 10. Further, the hot melt ink member 10 is rotatably supported around the shaft 11 and rotationally driven by a driving motor 12.

Figure 3:
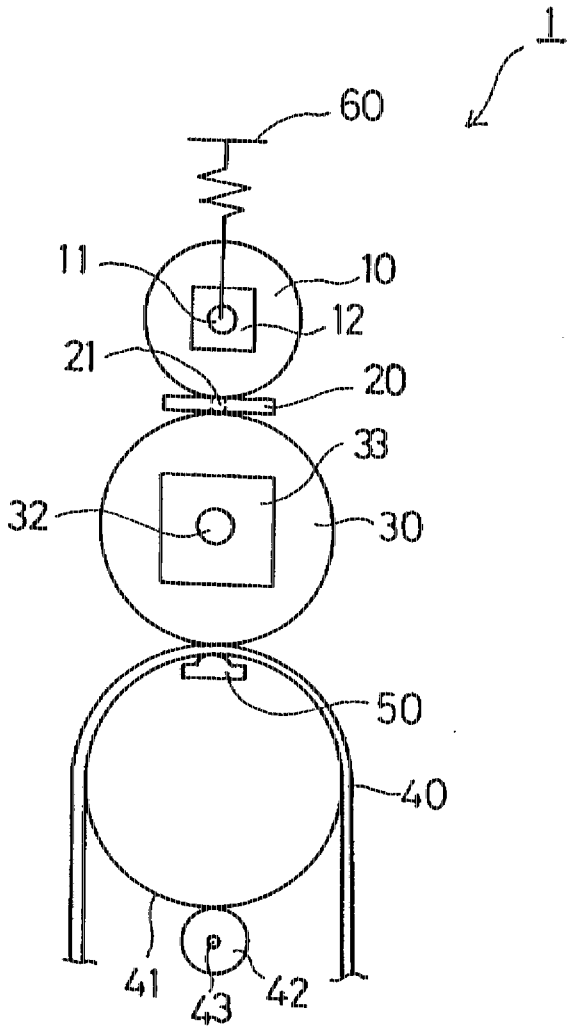
FIG. 3 is a schematic side view for an image forming device in another embodiment of the present invention.

Referring to FIG. 2, the ink retaining roller 30 is explained. The ink retaining roller 30 comprises a porous foamed resin shaped into a cylindrical roller and supported rotatably around a shaft 32. The ink retaining roller 30 is adapted to rotate following the rotation of the recording medium feed roller 41. As shown in FIG. 3, the ink retaining roller 30 can be adapted to be rotated by a driving motor 33 independently of the recording medium feed roller 41.

Figure 4:
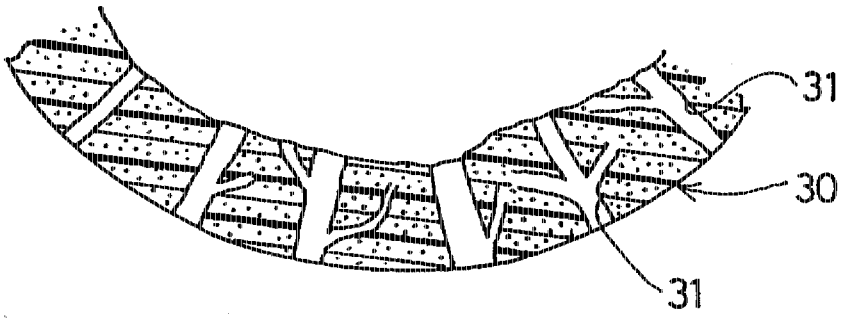
FIG. 4 is a schematic fragmentary cross sectional view for an ink retaining roll in one embodiment according to the present invention.

FIG. 4 shows a cross sectional view of the ink retaining roller 30. As shown in FIG. 4, a plurality of apertures 31 are formed in the ink retaining roller 30 so as to extend in the radial direction of the ink retaining roller 30. The apertures 31 act as capillaries to direct the flow of ink. With such a structure, when images are recorded on the recording medium 40, the apertures 31 in the ink retaining roller 30 are vertically brought into contact with the recording medium 40. Accordingly, since the flow of the ink heated and melted by the thermal head 50 is controlled to flow vertically relative to the recording medium 40, small dots can be formed on the recording medium 40 to provide an effect capable of increasing the resolution power of the recorded images.

Figure 5:
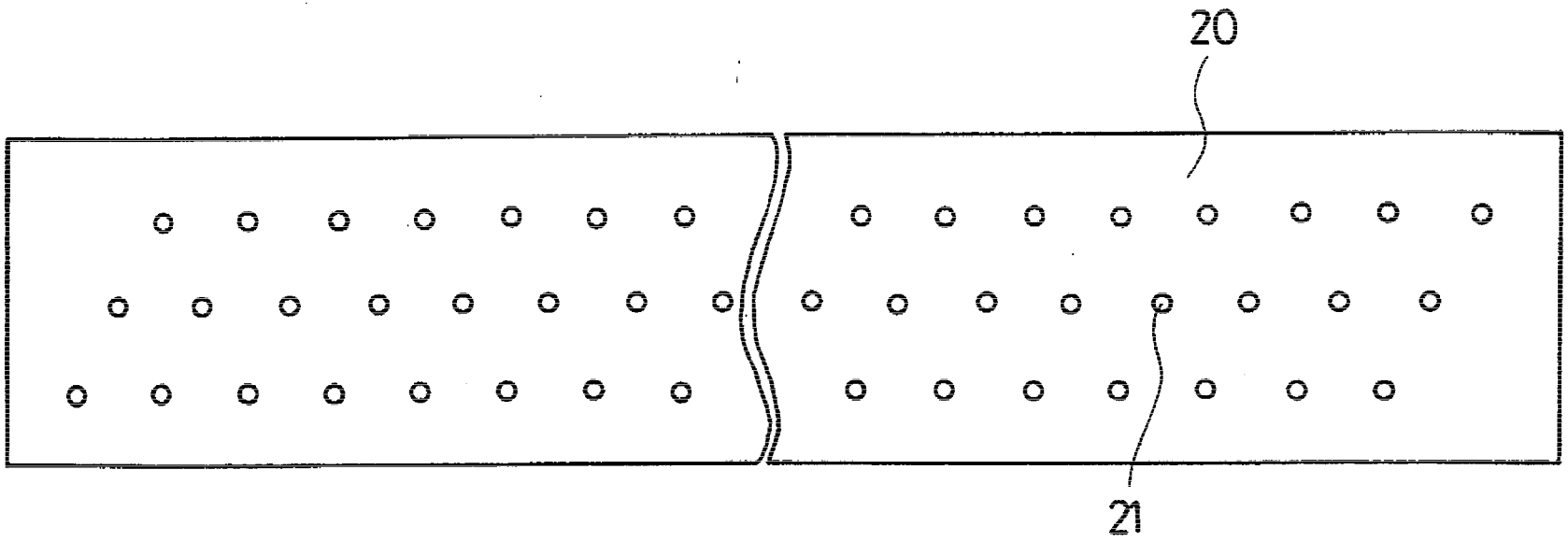
FIG. 5 is a plan view for a heater in one embodiment according to the present invention.

The structure of the heater 20 is explained with reference to FIG. 5. The heater 20 is formed by a thin stainless sheet having a plurality of small apertures 21. FIG. 5 shows an example of the arrangement for the small apertures 21, formed in three rows in a zigzag pattern each at about a 85 μm distance in the longitudinal direction of the heater 20 (right-to-left direction).

The right and left ends of the thus constituted heater 20 are connected to a not-illustrated power source by way of wirings, also not illustrated. The heater 20 generates heat in accordance with electric power supplied from the power source, not illustrated, to melt the hot melt ink member 10 pressed by the spring 60. The melted ink exudes from the small apertures 21 formed in the heater 20, is supplied to the ink retaining roller 30, and then is absorbed and retained in the ink retaining roller 30.

The recording medium feed roller 41 is formed as a hollow cylindrical roller, within which the thermal head 50 is retained by a not-illustrated retainer. In this case, a driving roller 42 is held by a shaft 43 to a lower portion of the recording medium feed roller 41 for rotating the recording medium feed roller 41 by frictional force. The shaft 43 is connected with a driving motor, not illustrated.

The thermal head 50 is retained in the recording medium feed roller 41 and disposed so as to oppose the ink retaining roller 30, with the recording medium 40 and the roller surface of the recording medium feed roller 41 being interposed therebetween. The thermal head 50 incorporates ohmic heat generating elements that generate heat by the application of electric signals corresponding to image signals outputted from a not illustrated driving control circuit, and has the same structure as that of the thermal head used for an existent thermal transfer type image forming device.

The operation of the image forming device 1 designed as described above is explained with reference to FIG. 2.

At first, the hot melt ink member 10 is preliminarily heated at a preliminary heating position by current supplied to the heater 20. By this heating, a portion of the hot melt ink member 10 is melted, absorbed, and retained by being dispersed in the ink retaining roller 30. Since the hot melt ink member 10 is rotatably held on the shaft 11 and rotated by the driving motor 12, the outer circumferential surface of the hot melt ink member 10 is melted uniformly over the entire circumference.

Subsequently, the ink retaining roller 30 is rotated, and the ink retained in the ink retaining roller 30 moves to an image forming position. Then, the thermal head 50 disposed at the image forming position generates heat in accordance with image signals. The ink retained in the apertures 31 of the ink retaining roller 30 is heated and melted with the heat. Then, the melted ink is melt-transferred to the recording medium 40 such as paper, and images are formed corresponding to the image signals on the recording medium 40.

The ink dispersed in the apertures 31 of the ink retaining roller 30 in the portion of the ink retaining roller 30 corresponding to the image signals is used for image formation. However, since the ink melted from the hot melt ink member 10 is successively supplied to the apertures 31 of the entire rotating ink retaining roller 30, the portion of the ink retaining roller 30 transported to the image forming position adjacent to the thermal head 50 always has ink dispersed and retained in the apertures 31.

Further, when the hot melt ink member 10 is exhausted, the hot melt ink member 10 may be replaced by detaching the spring 60 and attached a new hot melt ink member.

Figure 6:
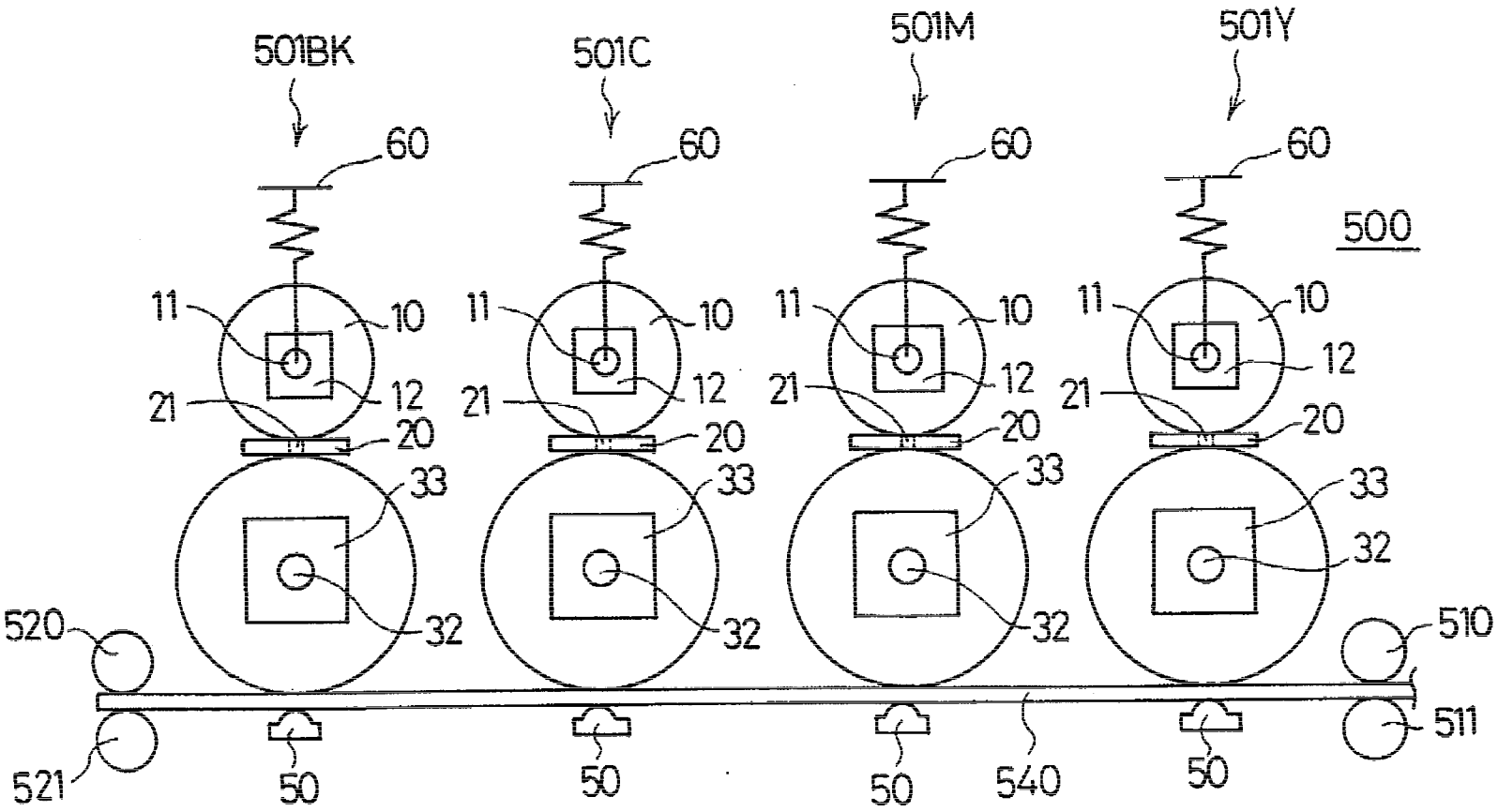
FIG. 6 is a schematic side view illustrating a color image forming apparatus using an image forming device according to the present invention.

FIG. 6 describes the image forming device of this embodiment applied to a color image forming apparatus.

The color image forming device 500 comprises an image forming device 501Y for forming yellow images, a magenta image forming device 501M for forming magenta images, a cyan image forming device 501C for forming cyan images and a black image forming device 501BK for forming black images. Each of the image forming devices 501Y, 501M, 501C and 501BK has the same constitution as that previously described specifically for the image forming device of the embodiment. Further, the color forming apparatus 500 is provided with paper feed rollers 510, 511 for sending a recording medium 540, and paper discharge rollers 520, 521 for discharging the recording medium 540 after image formation.

In operation when a printing operation is started under the control of a not-illustrated control device, yellow ink images are at first formed by the yellow image forming device 501Y on the recording medium 540. Then, magenta ink images are formed overlapping the yellow ink images on the recording medium 540 transported to the position for the magenta image forming device 501M. Further, the ink images comprising the overlapped ink images of the two colors are transported to the position for the cyan image forming device 501C on which cyan ink images are overlapped. Finally, they are transported to the position for the black image forming device 501BK and black ink images are overlapped to the ink images comprising the overlapped ink images of the three colors, by which full color images are formed on the recording medium 540 and outputted.

In the color forming apparatus 500 having the constitution described above, since it is necessary to replace only the ink medium of an exhausted color, inks of all colors can be used with no loss.

While this embodiment is adapted to form ink images in the order of yellow, magenta, cyan and black, the order is optional. Further, it is also possible to form color images of just three colors, that is, yellow, magenta and cyan, excluding black.

Figure 7:
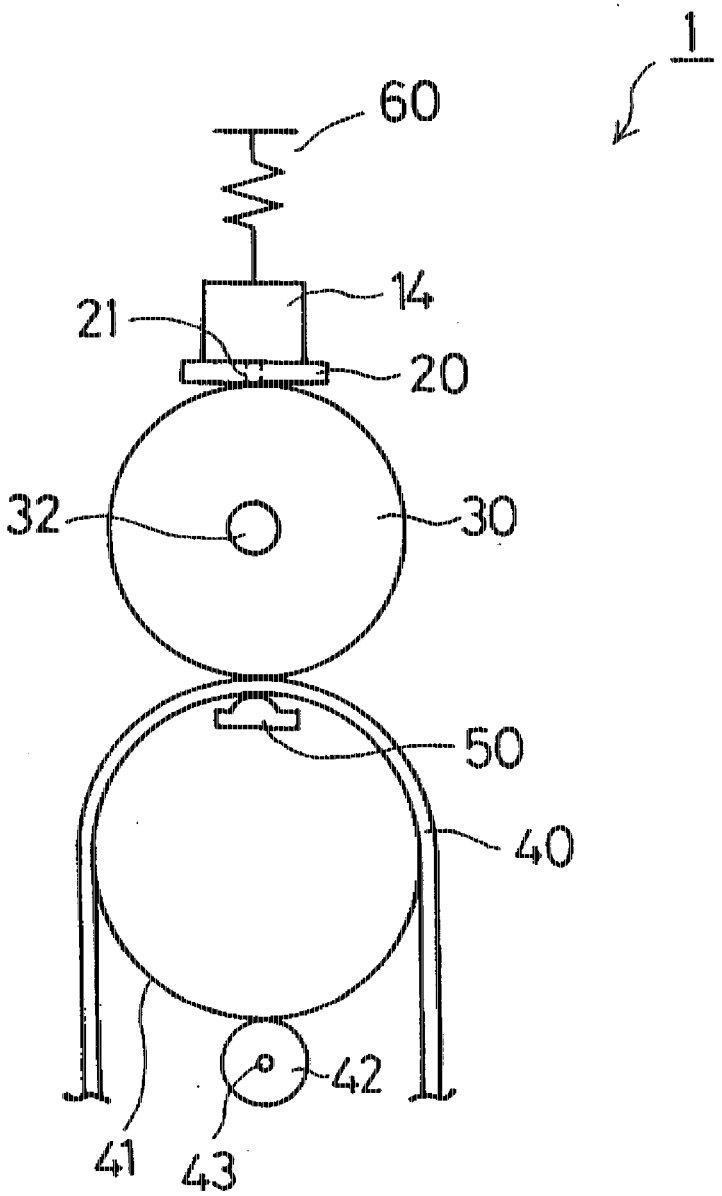
FIG. 7 is a schematic side view illustrating a further embodiment of the present invention.

In the embodiment described specifically above, the constitution of using a cylindrical ink roll has been illustrated as vehicle for the hot melt ink member 10. However, the ink retaining mechanism can be simplified by using a square cylindrical ink bar 14 as shown in FIG. 7.

Further, a thin stainless steel plate having small apertures 21 is used as the heater for the preliminary heating in this embodiment, but the present invention is not restricted to such a constitution. Effects equal with those in this embodiment can be obtained by using any other constitution. For example, a plurality of linear heaters may be arranged in parallel, provided that the hot melt ink can be melted by heating and supplied to the ink retaining body.

Figure 8:
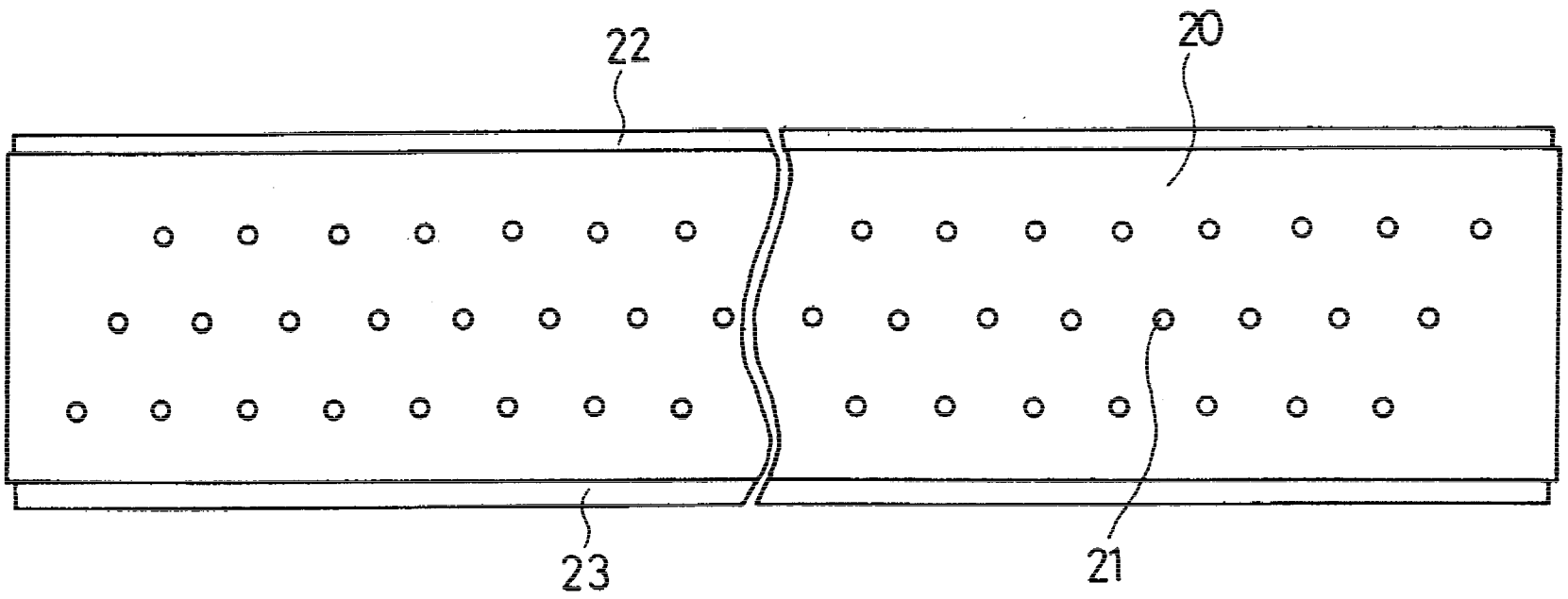
FIG. 8 is a plan view of a heater in a further embodiment according to the present invention.

For example, as shown in FIG. 8, the preliminary heating can be accomplished by forming a heater 20 with a copper or aluminum plate having good heat conductivity. Linear heaters 22, 23 are disposed at the upper and lower ends thereof, causing the heaters 22, 23 to generate heat and conduct heat to the heater 20, without direct supply of electric current to the heater 20, thereby melting the hot melt ink 10.

While advantageous embodiments have been chosen to illustrate the invention, it will be understood by those skilled in the art that various changes and modifications can be made therein without departing from the scope of the invention as defined in the appended claims.

What is claimed is:

1. An image forming device comprising:

a hot melt ink member;

heating means for melting ink from the hot melt ink member abutting the hot melt ink member;

ink retaining means disposed adjacent to the heating means for absorbing and retaining the ink melted by the heating means;

recording medium support means for supporting a recording medium for printing thereon; and thermal recording means disposed adjacent to the ink retaining means and the recording medium support means for heating the ink retained in the ink retaining means, thereby melting and transferring the ink onto the recording medium to effect printing.

2. The image forming device of claim 1 wherein the hot melt ink member is a solid ink unit.

3. The image forming device of claim 1 wherein the hot melt ink member is a roller of solid ink having an outer cylindrical surface, and a device is provided for rotatably driving the roller so that ink melts from the hot melt ink member at a substantially even rate from the outer cylindrical surface.

4. The image forming device of claim 1 wherein the hot melt ink member is a generally polygonal block of solid ink.

5. The image forming device of claim 1 further comprising a device for biasing the hot melt ink member against the heating means so as to press the heating means between the hot melt ink member and the ink retaining means.

6. The image forming device of claim 1 wherein the heating means comprises a generally flat plate with a plurality of apertures therein, wherein upon heating the plate melts ink from the hot melt ink member and the melted ink passes through the apertures to the ink retaining means.

7. The image forming device of claim 6 wherein the plate is a heating element.

8. The image forming device of claim 6 wherein the plate has at least one heating element thereon that heats the plate by conduction.

9. The image forming device of claim 8 wherein the at least one heating element is a linear heater disposed on the plate.

10. The image forming device of claim 1 wherein the ink retaining means is an ink retaining roller made of a porous material.

11. The image forming device of claim 10 wherein the ink retaining roller has a plurality of radial capillaries that retain ink therein so that ink is evenly transferred from the ink retaining roller to the recording medium by heating by the thermal recording means.

12. The image forming device of claim 10 further comprising a device for rotatably driving the ink retaining roller.

13. The image forming device of claim 1 wherein the ink retaining means is a foamed resin member with capillaries therein that retain the melted ink.

14. The image forming device of claim 1 wherein the recording medium support means is a hollow roller rotatable with respect to the thermal recording means.

15. The image forming device of claim 14 wherein the thermal recording means comprises a thermal head disposed within the hollow roller of the recording medium support means.

16. The image forming device of claim 1 wherein the thermal recording means comprises a thermal head.

17. The image forming device of claim 1 further comprising:

a plurality of said hot melt ink member, each hot melt ink member having a different color ink;

a plurality of said heating means for melting ink from the hot melt ink members abutting each of the hot melt ink members;

a plurality of said ink retaining means disposed adjacent to the heating means for absorbing and retaining the ink melted by the heating means from each respective hot melt ink member;

a plurality of said recording medium support means for supporting a recording medium for printing thereon; and a plurality of said thermal recording means disposed adjacent to the ink retaining means and the recording medium support means for heating the ink retained in the ink retaining means, thereby melting and transferring the ink onto the recording medium to effect printing.

18. A printing apparatus using hot melt ink, comprising:

at least one hot melt ink member;

a heater facing the at least one hot melt ink member that melts ink from the hot melt ink member;

at least one porous ink retaining member disposed adjacent to the heater that absorbs and retains the ink melted by the heater;

a recording medium support that is adapted to support a recording medium thereon for printing; and a thermal head facing the at least one ink retaining member that heats the ink retaining member to melt the ink retained therein and thereby transfer the ink onto the recording medium.

19. The printing apparatus of claim 18 wherein the at least one hot melt ink member is an ink roller, and a device is provided for rotating and biasing the ink roller against the heater.

20. The printing apparatus of claim 18 wherein the heater is a conductive plate having a plurality of apertures therein, whereby the ink melted from the at least one hot melt ink member flows through the apertures to the at least one ink retaining member.

21. The printing apparatus of claim 18 wherein the at least one porous ink retaining member is a roller with a plurality of radial capillaries that retain the ink therein.

22. The printing apparatus of claim 18 wherein the recording medium support is a hollow roller and the thermal head is disposed therein.

23. The printing apparatus of claim 18 further comprising a device for biasing the at least one hot melt ink member toward the recording medium support with the heater and the at least one ink retaining member pressed therebetween.

24. The printing apparatus of claim 18 wherein the at least one hot melt ink member comprises a plurality of hot melt ink members and the at least one ink retaining member comprises a plurality of ink retaining members, and wherein each hot melt ink member is a different color ink.

* * * * *